US006231442B1

(12) United States Patent
Mayeroff

(10) Patent No.: US 6,231,442 B1
(45) **Date of Patent: *May 15, 2001**

(54) VIDEO SLOT MACHINE WITH MULTI-CHOICE SECOND BONUS

(75) Inventor: Jason Mayeroff, Las Vegas, NV (US)

(73) Assignee: Battle Born Gaming, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/152,355

(22) Filed: Sep. 14, 1998

Related U.S. Application Data

(63) Continuation-in-part of application No. 09/112,225, filed on Jul. 8, 1998.

(51) Int. Cl.[7] ..... A63F 9/22
(52) U.S. Cl. ..... 463/20; 463/16
(58) Field of Search ..... 463/13–20, 9–12, 463/1, 25; 273/138.1

(56) References Cited

U.S. PATENT DOCUMENTS

| | | | | |
|---|---|---|---|---|
| 4,448,419 | | 5/1984 | Telnses | 273/143 R |
| 5,393,057 | * | 2/1995 | Marnell, II | 463/25 |
| 5,580,053 | * | 12/1996 | Crouch | 463/20 |
| 5,584,763 | * | 12/1996 | Kelly et al. | 463/16 |
| 5,722,891 | * | 3/1998 | Inoue | 463/20 |
| 5,788,573 | * | 8/1998 | Baerlocher et al. | 463/16 |
| 5,823,874 | | 10/1998 | Adams | 463/17 |
| 5,848,932 | * | 12/1998 | Adams | 463/20 |
| 5,947,820 | * | 9/1999 | Morro et al. | 463/9 |

OTHER PUBLICATIONS

IGT (Australia) PTY, Limited Brochure, "Games Fit for a King", 1998, 12 pages.

Bally Gaming Australia Brochure, "Bally is Back", no date, 6 pages.

* cited by examiner

*Primary Examiner*—Mark Sager
*Assistant Examiner*—John M Hotaling, II
(74) *Attorney, Agent, or Firm*—John Edward Roethel

(57) ABSTRACT

A slot machine is configured to have a main game comprising a video reel slot arrangement with at least five reels and at least nine paylines and a secondary event selection game comprising a selection game. Whenever the player achieves a combination of symbols on the main game that awards the player with the opportunity to play the secondary event selection game, the number of chances provided to the player to play the secondary event game is based on the number of paylines that the player has played on the main game or by the number of credits wagered on each payline. Alternatively, the number of selections awarded to the player on the secondary event game can be determined by the symbol combinations achieved by the player on the main game. All selections by the player in the secondary event selection game can be winning selections or, alternatively, the selections in the secondary event selection game can be either winning or losing selections.

40 Claims, 3 Drawing Sheets

VIDEO SLOT MACHINE WITH MULTI-CHOICE SECOND BONUS

CROSS-REFERENCE TO RELATED APPLICATION

This application is a Continuation-in-Part of application Ser. No. 09/112,225, filed Jul. 8, 1998, entitled "Reel Slot Machine", now pending.

This invention relates to a video reel slot machine, and more particularly to a video reel slot machine that displays a main video reel game with at least five reels and with at least nine or more paylines and a secondary event selection game that is displayed as a second video game.

BACKGROUND OF THE INVENTION

Reel slot machines have been used in gaming establishments for more than one hundred years. The traditional reel slot machine has three mechanical reels that rotate around a common horizontal axis. A reel strip is attached around the circumference of each slot reel and the reel strip contains a plurality of symbols thereon. As each reel comes to a stop, a symbol on the perimeter of the reel strip is displayed on a horizontal pay line on the face of the gaming machine. If the symbols that align on the payline match one of the preselected winning combinations, the player is a winner.

From the traditional three reel, single payline slot machine, newer slot machine concepts have evolved. Slot machines have been developed that have multiple paylines—such as additional horizontal paylines, diagonal paylines and even V-shaped paylines. The number of reels have been increased beyond the basic three reel slot machines; four reels, five reels and more have been used up to the classic Big Bertha slot machine that has ten reels.

Besides using mechanical reels, slot machines have been developed that use video representations of spinning reels. However, when video reel slot machines were initially developed, they were not as successful as the mechanical spinning reel slot machines because the players felt that their chances of winning were lower on video slot machines. On a mechanical spinning reel slot machine, a player has a feel for the number of symbols that are located on the reel strip which is mounted around the circumference of the spinning wheel and therefore the player perceives that he knows the odds of each symbol appearing on a payline. In a video slot machine, the player has no way of perceiving how many symbols are possible to appear in each window behind the payline. Therefore, the player perception is that he is receiving a better opportunity of winning on a mechanical spinning reel slot machine.

One of the more popular video reel slot machines in the world that has been created is a five reel, nine payline slot machine. These slot machines are known as "Australian" style slot machines since their genesis appears to have been in Australia. When the video representation of the reels stop spinning, fifteen symbols are displayed to the player disposed in three horizontal rows and five vertical columns. On this three-by-five matrix formed by the three rows and five columns of symbols that are shown, nine separate paylines are provided.

Payline #1 is the center horizontal row as shown:

| | | | | |
|---|---|---|---|---|
| | | | | |
| X | X | X | X | X |
| | | | | |

Payline #2 is the top horizontal row as shown:

| | | | | |
|---|---|---|---|---|
| X | X | X | X | X |
| | | | | |
| | | | | |

Payline #3 is the bottom horizontal row as shown:

| | | | | |
|---|---|---|---|---|
| | | | | |
| | | | | |
| X | X | X | X | X |

Payline #4 is a V-shaped configuration as shown:

| | | | | |
|---|---|---|---|---|
| X | | | | X |
| | X | | X | |
| | | X | | |

Payline #5 is an inverted V-shaped configuration as shown:

| | | | | |
|---|---|---|---|---|
| | | X | | |
| | X | | X | |
| X | | | | X |

Payline #6 is a W-shaped configuration as shown:

| | | | | |
|---|---|---|---|---|
| X | | X | | X |
| | X | | X | |
| | | | | |

Payline #7 is an inverted W-shaped configuration as shown:

| | | | | |
|---|---|---|---|---|
| | | | | |
| | X | | X | |
| X | | X | | X |

Payline #8 is another inverted W-shaped configuration as shown:

| | | | | |
|---|---|---|---|---|
| | X | | X | |
| X | | X | | X |
| | | | | |

Payline #9 is another W-shaped configuration as shown:

| | | | | |
|---|---|---|---|---|
| | | | | |
| X | | X | | X |
| | X | | X | |

These nine payline configurations are merely representative of any of a myriad of payline configurations that can be used and the number of paylines can be more or less than nine paylines.

Each coin, token or credit wagered by the player activates in sequential order the paylines. The player must wager nine coins to activate all nine paylines with one coin on each line. A maximum of five credits is usually allowed (although other gaming machines of this type can have a maximum number of credits less than five or more than five up to as many as twenty per payline) on each payline so the maximum wager by the player would be forty-five credits.

For example, there is in use in Australia a video reel slot machine that has twenty paylines and allows up to twenty coins, tokens or credits to be wagered on each payline.

A plethora of winning symbol combinations are provided so that the player has a large number of various opportunities to win depending on which symbols are displayed in which locations on the reels when the reels stop spinning.

In order to improve the player appeal of mechanical or video spinning reel slot machines, a recent development has been what are known as secondary event slot machines. In secondary event slot machines, the player first plays a main game. If a preselected event occurs during the play of the main game, the player is provided with a secondary event which allows the player an opportunity to win a bonus payout.

One of the first secondary event games that was created for the slot machine market is a game known as the "WHEEL OF FORTUNE" based on the television game show of the same name. When the third reel of the slot machine displayed a "Spin" symbol on the payline, the secondary event was represented by a replica spinning wheel. The player would press a special "Spin" button on the button panel of the gaming to activate the replica spinning wheel to rotate. When the replica spinning wheel came to rest after a few seconds, the player would win the amount shown in the arcuate segment demarcated by an indicator. The winning segment was randomly determined by the electronics of the game. The player could win as many as one thousand coins during this secondary event phase of the game.

The popularity of "WHEEL OF FORTUNE" spawned other secondary event games. Currently a very popular secondary event game is the video reel slot machine known as "REEL 'EM IN" which is an Australian style five reel, nine payline video slot machine that provides the player with a secondary event if certain preselected winning combinations are achieved on the paylines. In this game, which has a fishing theme, if the player achieves a secondary event opportunity, the first video screen display is replaced by a second video screen display which shows five fishermen sitting in boats. The player selects a fisherman and video animation shows the fisherman reeling in a fish. The size of the fish caught determines the multiplier applied to the amount of the player's wager which is how the secondary event payout is determined.

It is an object of the present invention to provide a video reel slot machine in which the main game has at least five reels and at least nine paylines and the secondary event game is a video display selection game and the player is provided with multiple chances at the secondary event game.

It is a feature of the present invention to provide, in the preferred embodiment, a slot machine with at least five video reels and at least nine paylines which also includes a secondary event selection game. The secondary event selection game, in the preferred embodiment, is a video display that allows the player to chose from a plurality of objects which will then reveal the amount won by the player, such as a plurality of wrapped presents placed under a Christmas tree. The player is also given multiple selections in the secondary event game with the number of selections based on the number of paylines that have been activated by the player prior to the spin of the reels in the main game, or by the number of coins played by the player on the main game or by the winning combinations achieved by the player in the main game.

It is an advantage of the present invention that the player will be encouraged to play more paylines in the main game or wager more coins in the main game or activate the main game more often since the player will receive multiple chances at the secondary event feature based on the number of paylines or the number of coins played by the player or by the frequency and type of winning combinations achieved by the player in the main game.

Other objects, features and advantages of the present invention will become apparent from a consideration of the following detailed description.

SUMMARY OF THE INVENTION

A slot machine is configured to have a main game comprising a video reel slot arrangement with at least five reels and at least nine paylines and a secondary event selection game comprising a selection game. Whenever the player achieves a combination of symbols on the main game that awards the player with the opportunity to play the secondary event selection game, the number of chances provided to the player to play the secondary event game is based on the number of paylines that the player has played on the main game or by the number of credits wagered on each payline. Alternatively, the number of selections awarded to the player on the secondary event game can be determined by the symbol combinations achieved by the player on the main game. All selections by the player in the secondary event selection game can be winning selections or, alternatively, the selections in the secondary event selection game can be either winning or losing selections.

DETAILED DESCRIPTION OF THE PREFERRED EMBODIMENTS

The present invention comprises a gaming machine having a first video display of video reels that are used as the main game played by the player and a second video display of the secondary event selection game to be played by the player when he achieves the opportunity to do so during the play of the main game.

Figure 1:
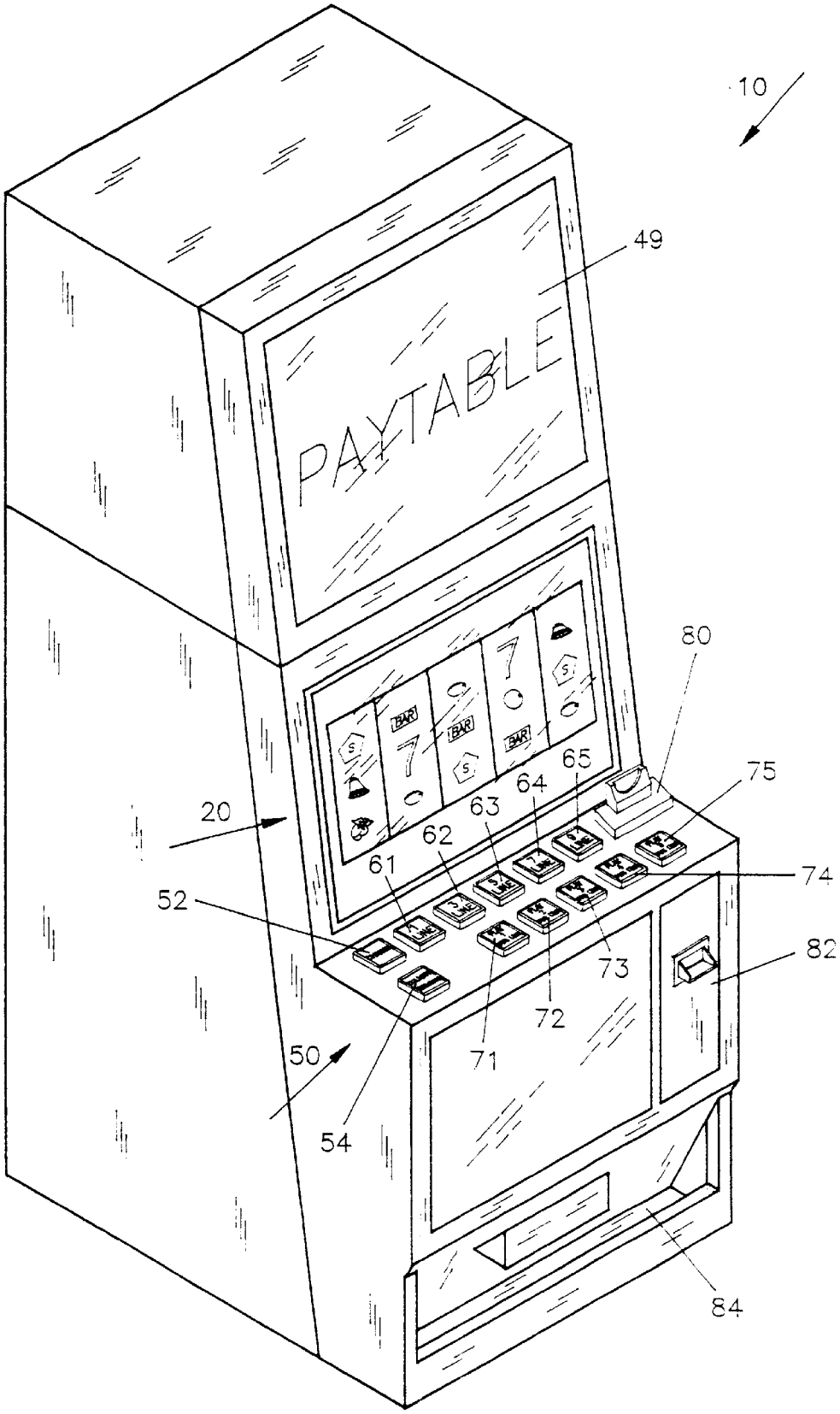
FIG. 1 shows an isometric view of a slot machine of the present invention.
Figure 2:
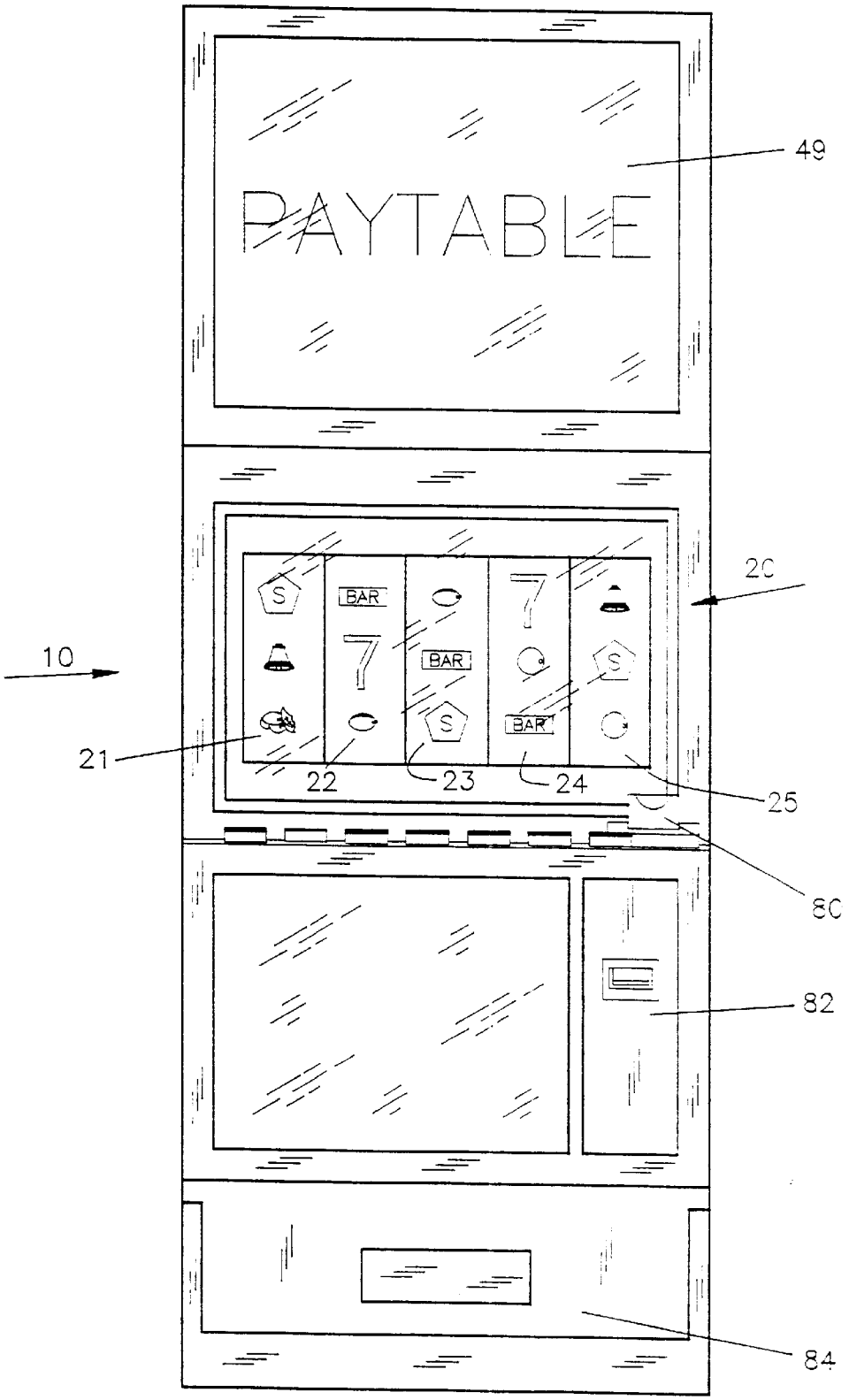
FIG. 2 shows a front view of the slot machine of the present invention.

FIGS. 1 and 2 show the gaming machine generally at 10. The gaming machine 10 is a conventional cabinet configuration with a first display 20 of video slot reels which are preferably located in generally the center section of the gaming machine cabinet. This video display screen 20 can also be used to display the secondary event selection game when the player achieves the opportunity to do so.

Also, at the top section of the gaming machine cabinet 10, there is provided a pay table 49 which shows the various winning combinations that the player is attempting to achieve both on the main game and on the secondary event game.

Additional components of the gaming machine 10 are such conventional items as a button panel 50 upon which are located the buttons used by the player to operate the gaming machine, such as a "Cash out" button 52, and a "Spin" button 54.

Also mounted on the button panel 50 are the buttons used by the player to select which paylines are to be active in the main game and the number of credits that are to be wagered on each active payline. In the preferred embodiment of the present invention, there are provided, on the same row as the "Cash Out" button 52, five payline selection buttons that are used to select the active paylines: the "One Payline" button 61, the "Three Payline" button 62, the "Five Payline" button 63, the "Seven Payline" button 64, and the "Nine Payline" button 65. Thus, in this configuration, the player can select to have active from among one, three, five, seven or nine paylines. Other payline selection configurations can be used to allow the player to select other combinations or any or all of the paylines to be active.

Again, in the preferred embodiment of the present invention, just below the payline selection buttons on the button panel 50, there are provided five wager selection buttons to allow the player to select the number of credits to be wagered on each payline: the "Bet One" button 71, the "Bet Two" button 72, the "Bet Three" button 73, the "Bet Four" button 74, and the "Bet Five" button 75. Thus, in this configuration, the player can select from between one and five credits to be wagered on each active payline. Other wager selection configurations can be used to allow the player to select the number of credits to be wagered on each active payline.

Other conventional components are the coin head 80, the bill acceptor 82 and the payout tray 84. The interior of the gaming machine 10 contains the electronic controls that are used to operate the gaming machine which are also conventional.

In one of the preferred embodiments of the present invention, the display screen 20 shows a video display representation of spinning slot reels using the conventional technology that is used in video reel slot machines. This video reel representation would display a five reel configuration with each reel 21, 22, 23, 24 and 25 displayed adjacent to each other on the video display screen 20. Each reel would appear to spin around a horizontal axis and each reel appears to have a reel strip which contains various symbols that are visible to the player as the reel spins. When the reels stop spinning, three rows of symbols are displayed to the player on a video screen resulting in a three-by-five matrix of symbols being displayed.

In accordance with the preferred embodiment of the present invention, nine paylines are provided. Any suitable combination of symbol positions can be utilized as paylines; however, in the preferred embodiment of the present invention, the nine paylines that are used in "Australian" style slot machines as described above are used since players have become familiar with this type of nine line payline configuration.

The secondary event selection game, in the preferred embodiment of the present invention, is a separate video display using the same screen that is used for the main game. When the player achieves a winning combination on the main game that earns the player the opportunity to play the secondary event selection game, the video screen display is refreshed with the video display for the secondary event selection game.

Figure 3:
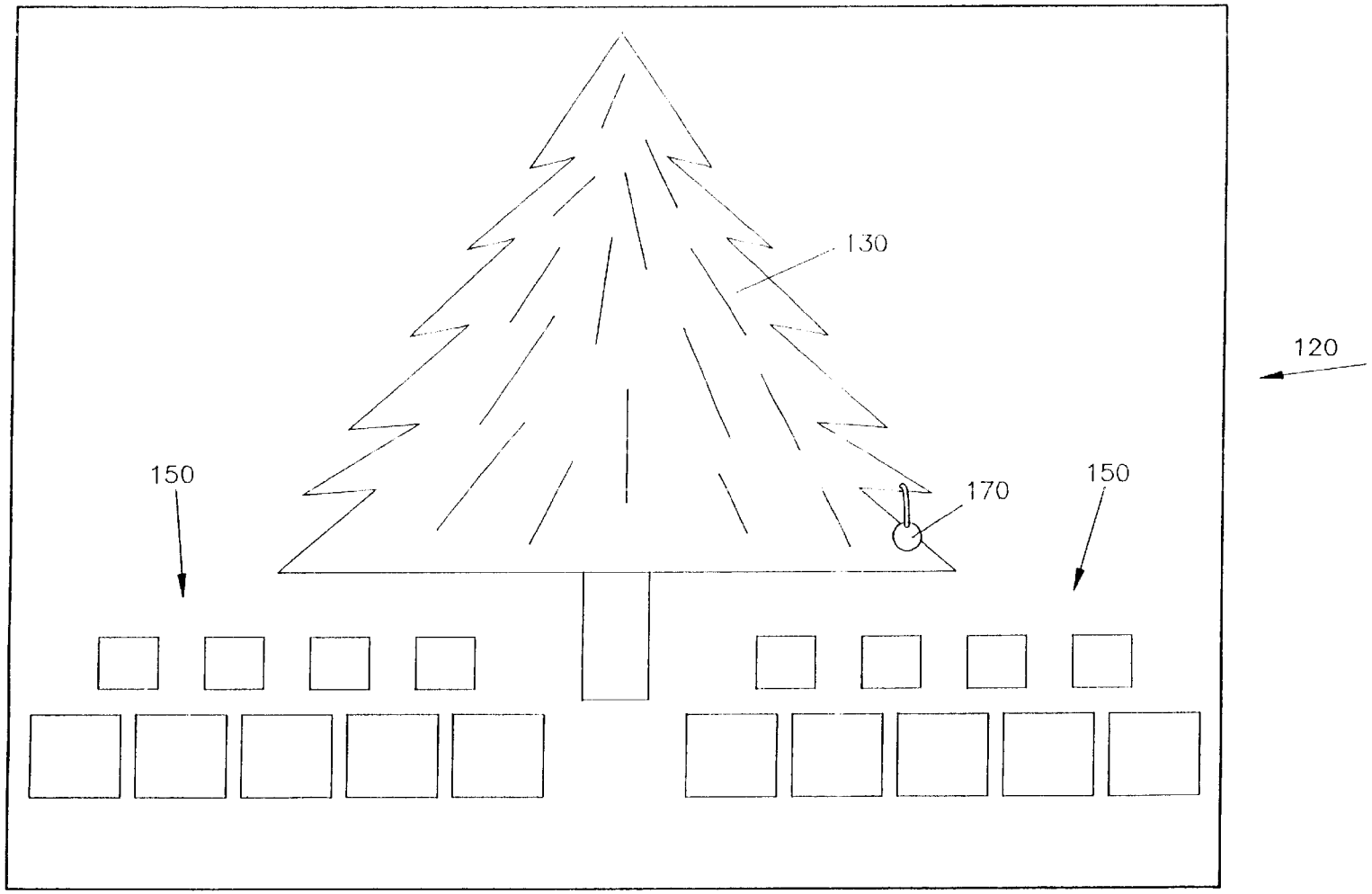
FIG. 3 shows a front view of the video screen display used as the secondary event selection game of the present invention.

FIG. 3 shows a representative screen display 120 for the secondary event selection game. In order to provide player appeal, it is suggested that a theme be used for the secondary event selection game such as the Christmas theme shown in FIG. 3. The screen display 120 would show a Christmas tree 130 surrounded by a group of Christmas presents 150. Each individual present represents an item available for selection by the player during the secondary event selection game. Additionally, a mystery multiplier item 170, in this theme represented by a Christmas ornament hanging on the Christmas tree 130, is associated with the secondary event selection game display 120.

The method of the present invention as practiced on the gaming machine 10 of the present invention is as follows:

A player inserts coins into the coin head 80 or paper currency into the bill acceptor 82. The amount inserted is accrued on a credit meter (not shown) which is conventional and which shows the number of accrued credits that the player has available to wager when playing the gaming machine. By pressing one of the payline selection buttons 61, 62, 63, 64 or 65, the player selects the number of paylines to be active during that play of the game. The player then selects one of the wager selection buttons 71, 72, 73, 74 or 75 to determine the number of credits to be wagered on each of the paylines that the player has activated for the upcoming spin of the reels.

Once the player has completed his wagering, the "Spin" button 54 (or alternatively a conventional pull handle) is activated and all five reels 21, 22, 23, 24 and 25 of the main video screen display 20 commence to spin. Each reel eventually comes to a stop and symbols are displayed in each of the locations of the three-by-five matrix displayed to the player. Certain symbol combinations have been preselected as winning combinations and are shown to the player in the pay table 49. If the player achieves a winning combination of symbols on any of the paylines, then the player wins. Any suitable pay table 49 can be used. An example of a representative pay table is shown in Table 1.

TABLE 1

| WINNING COMBINATIONS | | | | | PAYOUT |
|---|---|---|---|---|---|
| A | A | A | A | A | 5000 |
| A | A | A | A | XX | 2000 |
| A | A | A | XX | — | 150 |
| A | A | XX | — | — | 10 |
| B | B | B | B | B | 500 |
| B | B | B | B | XX | 75 |
| B | B | B | XX | — | 10 |
| B | B | XX | — | — | 2 |
| C | C | C | C | C | 500 |
| C | C | C | C | XX | 75 |
| C | C | C | XX | — | 10 |
| C | C | XX | — | — | 2 |
| D | D | D | D | D | 200 |
| D | D | D | D | XX | 50 |
| D | D | D | XX | — | 5 |
| E | E | E | E | E | 100 |
| E | E | E | E | XX | 25 |
| E | E | E | XX | — | 5 |
| F | F | F | F | F | 100 |
| F | F | F | F | XX | 25 |
| F | F | F | XX | — | 5 |
| G | G | G | G | G | 100 |
| G | G | G | G | XX | 25 |
| G | G | G | XX | — | 2 |
| H | H | H | H | H | 100 |
| H | H | H | H | XX | 25 |
| H | H | H | XX | — | 2 |
| I | I | I | I | I | 100 |
| I | I | I | I | XX | 10 |
| I | I | I | XX | — | 2 |

With regard to Table 1, the letters A, B, C, D, E, F, G, H and I represent suitable symbols that can be used on the video representations of the reel strips 21, 22, 23, 24 and 25. For example, the conventional fruit symbols could be used or, alternatively, a group of symbols representing a common theme could be used. The letters XX represent any symbol except the associated letter symbol in that line. The marking "--" represents any symbol including the associated letter symbol in that line.

If the player achieves any of the symbol combinations shown in Table 1 on any active payline, then the player is paid the payout amount for that symbol combination shown in the pay table multiplied by the number of credits wagered on that active payline. The payout is typically made by accruing credits on a credit meter which is provided in any suitable location on the gaming machine. The player then uses the credits accrued on the credit meter to make additional wagers on the gaming machine. Alternatively, any amounts won by the player can be paid from a coin hopper mounted on the interior of the gaming machine directly into the payout tray 84. When the player has completed his play of the gaming machine, the player collects his accrued credits by pressing the "Cash Out" button 52 and the coin hopper then dispenses coins into the payout tray 84 to pay the player. Alternatively, other conventional payout mechanisms, such as a ticket printer, can be used.

Additionally, there is provided another pay table which shows the winning symbol combinations on the main game that earn the player an opportunity to play the secondary event feature of the game which, in the present invention, is the secondary event selection game 120. The winning symbols that must be displayed on the main slot reels 21, 22, 23, 24 and 25 in order to earn the player the opportunity to play the secondary event game can be any suitable symbol combination which has been preselected. Table 2 shows a representative pay table that shows the winning symbols that earn the player the opportunity to play the secondary event selection game:

TABLE 2

| WINNING COMBINATIONS | | | | | PAYOUT |
|---|---|---|---|---|---|
| BS | XX | BS | XX | BS | SELECTION |
| BS | XX | BS | XX | XX | SELECTION |
| BS | XX | XX | XX | BS | SELECTION |
| XX | XX | BS | XX | BS | SELECTION |

With regard to Table 2, the letters "BS" represent a suitable bonus symbol that can be used on the reel strips 21, 22, 23, 24 and 25 and indicate to the player that this symbol relates to the secondary event feature. The letters "XX" represent any symbol but the associated letter symbol in that line.

In one of the preferred embodiments of the present invention, if the player achieves one of the winning combinations shown in Table 2 and earns the opportunity to play the secondary event selection game, the number of plays on the secondary event selection game is equal to the number of paylines that the player has activated on the main game. For example, if the player has played all nine paylines on the main game and achieves a winning combination shown in Table 2, then the player will win nine selections on the secondary event selection game 120.

Alternatively, the number of selections on the secondary event game can be determined by the number of credits wagered by the player on the paylines of the main game. For example, if the player has wagered five credits on each payline of the main game, the player would win five selections on the secondary event selection game 120.

Another alternative variation that can be used has the number of selections on the secondary event selection game determined by the symbol combination achieved on the reels of the main game. In this variation of the present invention, the player would always be awarded at least two selections on the secondary event game for a winning combination on the main game. For example, if the player would achieve three cherries on an active payline, the number of selections on the secondary event selection game could be two selections; four cherries could yield five selections; and five cherries could yield ten selections. Any suitable symbol combinations could be used as well as any suitable number of selections on the secondary event selection game.

With regard to FIG. 3, the player selects one of the presents 150 with each selection provided to the player. In the preferred embodiment of the present invention, the player makes this selection by touching the video screen 120 at the location of the present desired to be selected by the player. Conventional touch screen technology can be used. Alternatively, other technology can be used to allow the player to effect his selection such as a light pen or buttons provided on the button panel.

As each present 150 is selected by the player, an amount to be won by the player is revealed on the selected present. For example, a number could be displayed on the symbol of the present or the present could be opened and a number prize could pop out of the present. Because there are a plurality of presents 150, a range of award amounts can be randomly distributed among the presents.

One variation that can be made to the present invention is to include a "Mystery Multiplier" feature as part of the secondary event selection game. A suitable display can be added to the gaming machine, e.g. a Christmas ornament 170 hanging from a bough of the Christmas tree 130 that will display multiplier numbers. At randomly selected times during the play of the secondary event selection game, a number is randomly selected and displayed in the Christmas ornament and that number is used as a multiplier for any selections made by the player during the play of the secondary event selection game.

In the preferred embodiment, the multiplier number is an integer selected from the group of integers 2, 3, 4, 5, 6 and 10. The probability of any particular integer being the selected integer is weighted so that the overall average mystery multiplier is some multiple of the winning amount, such as three times the winning amount. Any suitable group of multiplier integers can be used and the probability can be weighted to be any suitable average multiplier amount.

Of course other themes besides a Christmas theme can be used for the secondary event selection game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding a play of the secondary event selection game for each payline activated on the main game; and f) awarding a payout for each selection object chosen during the secondary event selection game.

2. The method of claim 1 in which a multiplier number is randomly selected at randomly determined intervals during the play of the secondary event selection game and the multiplier number is used to increase the amount of payouts achieved during the play of the secondary event selection game.

3. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding a play of the secondary event selection game for each credit wagered on a payline of the main game; and f) awarding a payout for each selection object chosen during the secondary event selection game.

4. The method of claim 3 in which a multiplier number is randomly selected at randomly determined intervals during the play of the secondary event selection game and the multiplier number is used to increase the amount of payouts achieved during the play of the secondary event selection game.

5. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding two or more plays of the secondary event selection game based on which preselected secondary event selection game combination appears on a payline of the main game; and f) awarding a payout for each selection object chosen during the secondary event selection game.

6. The method of claim 5 in which a multiplier number is randomly selected at randomly determined intervals during the play of the secondary event selection game and the multiplier number is used to increase the amount of payouts achieved during the play of the secondary event selection game.

7. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding a play of the secondary event selection game for each payline activated on the main game; and f) means for awarding a payout on each selection object chosen during the secondary event selection game.

8. The gaming machine of claim 7 further including means for randomly selecting a multiplier number at randomly determined intervals during the play of the secondary event selection game and means for increasing the amount of payouts achieved during the play of the secondary event selection game by the amount of the multiplier number.

9. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding a play of the secondary event selection game for each credit wagered on a payline on the main game; and f) means for awarding a payout on each selection object chosen during the secondary event selection game.

10. The gaming machine of claim 9 further including means for randomly selecting a multiplier number at randomly determined intervals during the play of the secondary event selection game and means for increasing the amount of payouts achieved during the play of the secondary event selection game by the amount of the multiplier number.

11. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, awarding two or more plays of the secondary event selection game based on which preselected secondary event selection game combination appears on a payline on the main game; and f) means for awarding a payout on each selection object chosen during the secondary event selection game.

12. The gaming machine of claim 11 further including means for randomly selecting a multiplier number at randomly determined intervals during the play of the secondary event selection game and means for increasing the amount of payouts achieved during the play of the secondary event selection game by the amount of the multiplier number.

13. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding one or more plays of the secondary event selection game based on the number of paylines activated on the main game; and f) awarding a payout for each selection object chosen during the secondary event selection game.

14. The method of claim 13 in which a multiplier number is randomly selected at randomly determined intervals during the play of the secondary event selection game and the multiplier number is used to increase the amount of payouts achieved during the play of the secondary event selection game.

15. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding one or more plays of the secondary event selection game based on the number of credits wagered on a payline on the main game; and f) awarding a payout for each selection object chosen during the secondary event selection game.

16. The method of claim 15 in which a multiplier number is randomly selected at randomly determined intervals during the play of the secondary event selection game and the multiplier number is used to increase the amount of payouts achieved during the play of the secondary event selection game.

17. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding one or more plays of the secondary event selection game based on the number of paylines activated on the main game; and f) means for awarding a payout on each selection object chosen during the secondary event selection game.

18. The gaming machine of claim 17 further including means for randomly selecting a multiplier number at randomly determined intervals during the play of the secondary event selection game and means for increasing the amount of payouts achieved during the play of the secondary event selection game by the amount of the multiplier number.

19. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding one or more plays of the secondary event selection game based on the number of credits wagered on a payline on the main game; and f) means for awarding a payout on each selection object chosen during the secondary event selection game.

20. The gaming machine of claim 19 further including means for randomly selecting a multiplier number at randomly determined intervals during the play of the secondary event selection game and means for increasing the amount of payouts achieved during the play of the secondary event selection game by the amount of the multiplier number.

21. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding a play of the secondary event selection game for each payline activated on the main game; and f) awarding a payout for each winning selection object chosen during the secondary event selection game.

22. The method of claim 21 in which a multiplier number is randomly selected at randomly determined intervals during the play of the secondary event selection game and the multiplier number is used to increase the amount of payouts achieved during the play of the secondary event selection game.

23. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding a play of the secondary event selection game for each credit wagered on a payline on the main game; and f) awarding a payout for each winning selection object chosen during the secondary event selection game.

24. The method of claim 23 in which a multiplier number is randomly selected at randomly determined intervals during the play of the secondary event selection game and the multiplier number is used to increase the amount of payouts achieved during the play of the secondary event selection game.

25. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding two or more plays of the secondary event selection game based on which preselected secondary event selection game combination appears on a payline on the main game; and f) awarding a payout for each winning selection object chosen during the secondary event selection game.

26. The method of claim 25 in which a multiplier number is randomly selected at randomly determined intervals during the play of the secondary event selection game and the multiplier number is used to increase the amount of payouts achieved during the play of the secondary event selection game.

27. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding a play of the secondary event selection game for each payline activated on the main game; and f) means for awarding a payout on each winning selection object chosen during the secondary event selection game.

28. The gaming machine of claim 27 further including means for randomly selecting a multiplier number at randomly determined intervals during the play of the secondary event selection game and means for increasing the amount of payouts achieved during the play of the secondary event selection game by the amount of the multiplier number.

29. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding a play of the secondary event selection game for each credit wagered on a payline on the main game; and f) means for awarding a payout on each winning selection object chosen during the secondary event selection game.

30. The gaming machine of claim 29 further including means for randomly selecting a multiplier number at randomly determined intervals during the play of the secondary event selection game and means for increasing the amount of payouts achieved during the play of the secondary event selection game by the amount of the multiplier number.

31. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, awarding two or more plays of the secondary event selection game based on which preselected secondary event selection game combination appears on a payline on the main game; and f) means for awarding a payout on each winning selection object chosen during the secondary event selection game.

32. The gaming machine of claim 31 further including means for randomly selecting a multiplier number at randomly determined intervals during the play of the secondary event selection game and means for increasing the amount of payouts achieved during the play of the secondary event selection game by the amount of the multiplier number.

33. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding one or more plays of the secondary event selection game based on the number of paylines activated on the main game; and f) awarding a payout for each winning selection object chosen during the secondary event selection game.

34. The method of claim 33 in which a multiplier number is randomly selected at randomly determined intervals during the play of the secondary event selection game and the multiplier number is used to increase the amount of payouts achieved during the play of the secondary event selection game.

35. A method of playing a gaming machine having a main video reel slot machine with at least five reels and at least nine paylines and a secondary event selection game with multiple selection objects, comprising:

a) making a wager of at least one credit on at least one of the paylines on the main slot machine;

b) activating the main slot machine to cause the reels to spin;

c) when the reels stop spinning, determining which symbols appear on the paylines upon which a wager has been made;

d) awarding a payout if one or more of preselected winning combinations appear on any of the paylines on which a wager has been made;

e) if a preselected secondary event selection game combination is achieved on the main game, awarding one or more plays of the secondary event selection game based on the number of credits wagered on a payline on the main game; and f) awarding a payout for each winning selection object chosen during the secondary event selection game.

36. The method of claim 35 in which a multiplier number is randomly selected at randomly determined intervals during the play of the secondary event selection game and the multiplier number is used to increase the amount of payouts achieved during the play of the secondary event selection game.

37. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding one or more plays of the secondary event selection game based on the number of paylines activated on the main game; and f) means for awarding a payout on each winning selection object chosen during the secondary event selection game.

38. The gaming machine of claim 37 further including means for randomly selecting a multiplier number at randomly determined intervals during the play of the secondary event selection game and means for increasing the amount of payouts achieved during the play of the secondary event selection game by the amount of the multiplier number.

39. A gaming machine having a main video reel slot machine with at least five reels and at least nine paylines and a secondary event selection game with multiple selection objects, comprising:

a) means for making a wager of at least one credit on at least one of the paylines on the main slot machine;

b) means for activating the main slot machine to cause the reels to spin;

c) when the reels stop spinning, means for determining which symbols appear on the paylines upon which a wager has been made;

d) means for awarding a payout if one or more of preselected winning combinations appear on any of the paylines on which a wager has been made;

e) if a preselected secondary event selection game combination is achieved on the main game, means for awarding one or more plays of the secondary event selection game based on the number of credits wagered on a payline on the main game; and f) means for awarding a payout on each winning selection object chosen during the secondary event selection game.

40. The gaming machine of claim 39 further including means for randomly selecting a multiplier number at randomly determined intervals during the play of the secondary event selection game and means for increasing the amount of payouts achieved during the play of the secondary event selection game by the amount of the multiplier number.

* * * * *